US009196410B2

(12) United States Patent
Lee

(10) Patent No.: US 9,196,410 B2
(45) Date of Patent: Nov. 24, 2015

(54) CHIP INDUCTOR AND METHOD OF MANUFACTURING THE SAME

(71) Applicant: Samsung Electro-Mechanics Co., Ltd., Gyeonggi-do (KR)

(72) Inventor: Heoung Sub Lee, Busan (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 0 days.

(21) Appl. No.: 13/899,480

(22) Filed: May 21, 2013

(65) Prior Publication Data

US 2013/0314193 A1 Nov. 28, 2013

(30) Foreign Application Priority Data

May 22, 2012 (KR) ..... 10-2012-0054239
May 14, 2013 (KR) ..... 10-2013-0054373

(51) Int. Cl.
*H01F 5/00* (2006.01)
*H01F 17/00* (2006.01)
*H01F 41/04* (2006.01)

(52) U.S. Cl.
CPC ..... *H01F 17/0013* (2013.01); *H01F 5/00* (2013.01); *H01F 17/0033* (2013.01); *H01F 41/041* (2013.01); *H01F 41/046* (2013.01); *Y10T 156/1057* (2015.01)

(58) Field of Classification Search
CPC ..... H01F 5/00; H01F 27/00–27/30
USPC ..... 336/65, 83, 200, 232
See application file for complete search history.

(56) References Cited

U.S. PATENT DOCUMENTS 8,587,400 B2 * 11/2013 Nakajima et al. ..... 336/200
2007/0188288 A1 * 8/2007 Ishii ..... 336/200

FOREIGN PATENT DOCUMENTS

JP 2000-286125 A 10/2000
JP 2001-358018 A 12/2001
JP 2008-078226 A 4/2008
JP 2011-085258 A 4/2011
JP 2012-025607 A 2/2012
JP 2012-028522 A 2/2012
KR 10-2001-0005161 A 1/2011

OTHER PUBLICATIONS

JP 2013-107127 Office Action dated Nov. 26, 2013; 2pgs.
KR 10-2013-0054373 Notice of Allowance dated Mar. 13, 2014; 2pgs.

* cited by examiner

*Primary Examiner* — Tuyen Nguyen
(74) *Attorney, Agent, or Firm* — McDermott Will & Emery LLP

(57) ABSTRACT

Disclosed herein are a chip inductor and a method of manufacturing the same. The chip inductor includes: a laminate in which a magnetic sheet having a C-pattern electrode formed thereon and a magnetic sheet having an I-pattern electrode formed thereon are alternately laminated; a via penetrating through the magnetic sheet and connecting the C-pattern electrode and the I-pattern electrode; and an external electrode terminal provided at either side portion of the laminate.

10 Claims, 17 Drawing Sheets

CHIP INDUCTOR AND METHOD OF MANUFACTURING THE SAME

CROSS REFERENCE(S) TO RELATED APPLICATIONS

This application claims the benefit under 35 U.S.C. Section 119 of Korean Patent Application Serial No. 10-2012-0054239, entitled "Chip Inductor and Method of Manufacturing the Same" filed on May 22, 2012, which is hereby incorporated by reference in its entirety into this application.

BACKGROUND OF THE INVENTION

1. Technical Field

The present invention relates to a chip inductor, and more particularly, to a pattern electrode in a chip inductor.

2. Description of the Related Art

In accordance with recent remarkable development of electronic and communication devices, the electronic and communication devices are frequently used. Due to the frequent use, communication problems caused by interference between the devices also frequently occur. Therefore, regulations on electromagnetic interference have been tightened to improve electromagnetic environment caused by use of wireless communication devices and multimedia devices.

Accordingly, it is recently required to develop components for eliminating electromagnetic wave interference. Along with rapid increase in demand for the components, the components have been developed to have complicated functions, to be highly integrated and to be highly effective. Among others, laminated chip inductors are filters to eliminate high-frequency noise, and are commonly used in personal computers, telephones and communication devices.

A conventional chip inductor, as is disclosed in Korean Patent Laid-Open Publication No. 2001-0005161, mainly includes a laminate in which a number of magnetic sheets having printed inner electrodes are laminated, and external electrode terminals at two side portions of the laminate.

Here, the inner electrodes have the same shape for the sake of manufacturing convenience. For example, FIG. 11 shows the chip inductor proposed in the prior art document in which all of the inner electrodes 1 in the layers have electrodes patterned in the ∩ shape, except for the uppermost and lowermost layers.

In this structure, however, if a laminate alignment error between magnetic sheets occurs during the process of laminating hundreds of magnetic sheets, the inner cross-sectional area of the coil is greatly changed, such that inductance is not controlled to a constant value.

For example, if a magnetic sheet in the upper or lower layer is moved inward as shown in FIG. 12A, the length L1 between inner electrodes in the upper and lower layers is abnormally reduced, thereby reducing the inner cross-sectional of the coil. Further, if a magnetic sheet in the upper or lower layer is moved outward as shown in FIG. 12B, the length L2 between inner electrodes in the upper and lower layers is abnormally increased, thereby increasing the inner cross-sectional area of the coil.

Since recent electronic and communication devices have complicated functions, are highly integrated and miniaturized, it is necessary to more precisely control inductance. However, the change in inductance due to the laminate alignment error damages reliability of products, and especially in the case shown in FIG. 12B the inner electrode terminal and the external electrode terminal may cause a short circuit.

RELATED ART DOCUMENT

Patent Document (Patent Document 1) Korean Patent Laid-Open Publication No. 2001-0005161

SUMMARY OF THE INVENTION

An object of the present invention is to provide a chip inductor which has no change in inductance even if a laminate alignment error occurs, and a method of manufacturing the same.

According to an exemplary embodiment of the present invention, there is provided a chip inductor, including: a laminate in which a magnetic sheet having a C-pattern electrode formed thereon and a magnetic sheet having an I-pattern electrode formed thereon are alternately laminated; a via penetrating through the magnetic sheet and connecting the C-pattern electrode and the I-pattern electrode; and an external electrode terminal provided at either side portion of the laminate.

The via may include: a first via formed on the magnetic sheet on which the C-pattern electrode is formed and connecting one end of the C-pattern electrode to one end of the I-pattern electrode; and a second via formed on the magnetic sheet on which the I-pattern electrode is formed and connecting the other end of the I-pattern electrode to the other end of the C-pattern electrode.

A pattern line of the C-pattern electrode may be a circle, an ellipse, and a quadrangle.

A gap between the ends of the C-pattern electrode may be between 5 μm and 100 μm.

A length of the I-pattern electrode may be greater than the gap between the ends of the C-pattern electrode.

A ratio of the length of the I-pattern electrode to the gap between the ends of the C-pattern electrode may be between 1.1 and 1.3.

Assuming the magnetic sheet as four virtual quadrants, the gap between the ends of the C-pattern may be placed on any one of the quadrants or placed over two adjacent quadrants.

The chip inductor may further include a magnetic sheet having a lead-out electrode formed thereon in each of an uppermost layer and lowermost layer of the laminate, wherein one end of the lead-out electrode formed on the magnetic sheet in the uppermost layer is connected to the external electrode terminal at the left hand (or right hand) and the other end is connected to a C-pattern electrode or an I-pattern electrode in a lower layer, and wherein one end of the lead-out electrode formed on the magnetic sheet in the lowermost layer is connected to the external electrode terminal at the right hand (or left hand) and the other end is connected to a C-pattern electrode or an I-pattern electrode in a upper layer.

Among two ends of the C-pattern electrode connected to the lead-out electrodes, the end closer to the external electrode terminal at the right hand may be connected to the lead-out electrode connected to the external electrode terminal at the left hand, and the end closer to the external electrode terminal at the left hand may be connected to the lead-out electrode connected to the external electrode terminal at the right hand.

Among two ends of the I-pattern electrode connected to the lead-out electrodes, the end closer to the external electrode terminal at the right hand may be connected to the lead-out electrode connected to the external electrode terminal at the right hand, and the end closer to the external electrode terminal at the left hand may be connected to the lead-out electrode connected to the external electrode terminal at the left hand.

According to another exemplary embodiment of the present invention, there is provided a method of manufacturing a chip inductor, including: laminating a magnetic sheet having a C-pattern electrode formed thereon and a magnetic sheet having an I-pattern electrode formed thereon alternately; pressing and sintering the laminated magnetic sheet; and forming an external electrode terminal at either side portion of the laminate obtained through the pressing and sintering.

According to another exemplary embodiment of the present invention, there is provided a method of manufacturing a chip inductor, including: forming a C-pattern electrode or an I-pattern electrode on each of divided regions on a magnetic sheet, the C-pattern electrode and the I-pattern electrode being placed alternately; forming a plurality of the magnetic sheets, wherein the magnetic sheet in an upper layer or a lower layer is moved so that the C-pattern electrode in the upper layer (or I-pattern electrode in the upper layer) and the I-pattern electrode in the lower layer (or the C-pattern electrode in the lower layer) are aligned; pressing and sintering the laminated magnetic sheets, and cutting the laminate on each region into individual laminate; and forming an external electrode terminal at either side portion of the individual laminate.

The method of manufacturing a chip inductor may further include forming a via at a predetermined location on the magnetic sheet prior to the forming of the C-pattern electrode or the I-pattern electrode on the magnetic sheet.

In the forming of the C-pattern electrode or the I-pattern electrode on the magnetic sheet, the C-pattern electrode and the I-pattern electrode may be alternately placed in the x-axis direction. In the laminating of the magnetic sheet, a magnetic sheet in an upper or lower layer may be moved in the x-axis directions by one region.

In the forming of the C-pattern electrode or the I-pattern electrode on the magnetic sheet, the C-pattern electrode and the I-pattern electrode may be alternately placed in the y-axis direction. In the laminating of the magnetic sheet, a magnetic sheet in an upper or lower layer may be moved in the y-axis directions by one region.

In the forming of the C-pattern electrode or the I-pattern electrode on the magnetic sheet, the C-pattern electrode and the I-pattern electrode may be alternately placed in the x- and y-axis directions. In the laminating of the magnetic sheets, a magnetic sheet in an upper or lower layer may be moved in each of the x- and y-axis directions by one region.

According to another exemplary embodiment of the present invention, there is provided a method of manufacturing a chip inductor, including: forming a C-pattern electrode on each of divided regions on a first magnetic sheet, and forming a I-pattern electrode on each of divided regions on a second magnetic sheet; laminating the first magnetic sheet and the second magnetic sheet alternately; pressing and sintering the laminated magnetic sheet, and cutting the laminate on each region into individual laminate; and forming an external electrode terminal at either side portion of the individual laminate.

DESCRIPTION OF THE PREFERRED EMBODIMENTS

Various advantages and features of the present invention and methods accomplishing thereof will become apparent from the following description of exemplary embodiments with reference to the accompanying drawings. However, the present invention may be modified in many different forms and it should not be limited to exemplary embodiments set forth herein. These exemplary embodiments may be provided so that this disclosure will be thorough and complete, and will fully convey the scope of the invention to those skilled in the art.

Terms used in the present specification are for explaining exemplary embodiments rather than limiting the present invention. Unless explicitly described to the contrary, a singular form includes a plural form in the present specification. The components, steps, operations and/or elements stated herein do not exclude the existence or addition of one or more other components, steps, operations and/or elements.

Hereinafter, a configuration and an acting effect of exemplary embodiments of the present invention will be described in more detail with reference to the accompanying drawings.

Figure 1:
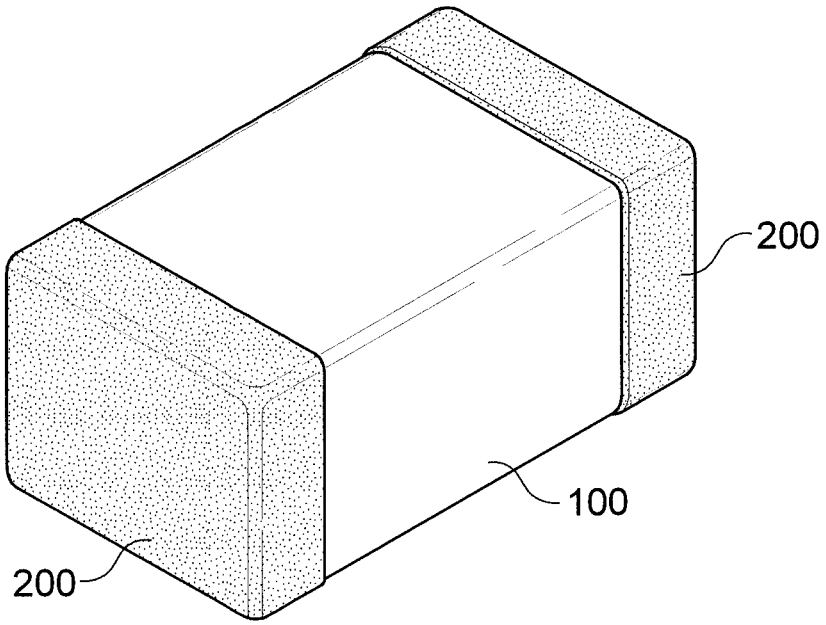
FIG. 1 is a perspective view showing an appearance of a chip inductor according to an exemplary embodiment of the present invention.
Figure 2:
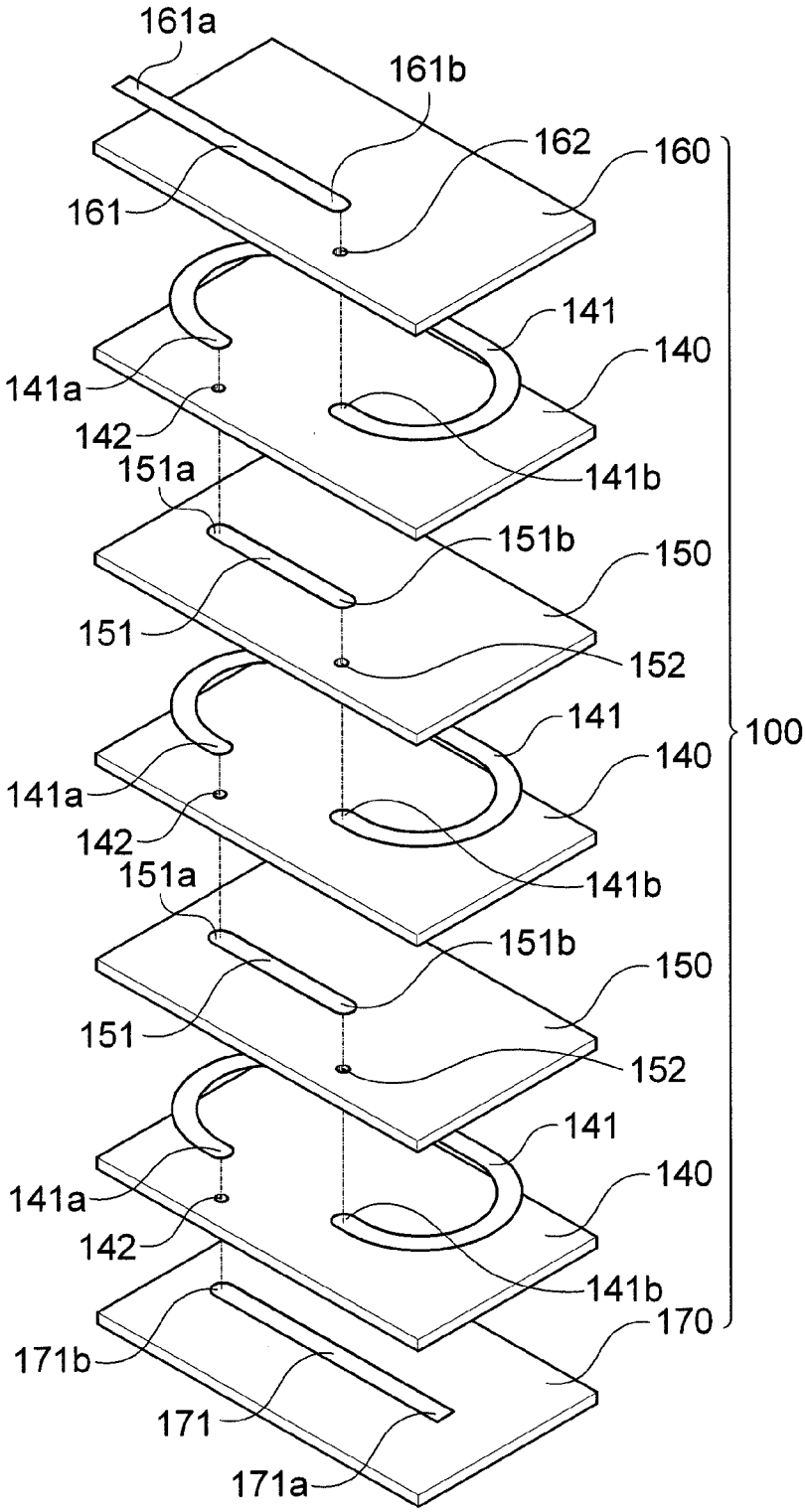
FIG. 2 is an exploded perspective view of the chip inductor according to the exemplary embodiment.

FIG. 1 is a perspective view showing an appearance of a chip inductor according to an exemplary embodiment of the present invention, and FIG. 2 is an exploded perspective view of the chip inductor according to the exemplary embodiment.

Referring to FIGS. 1 and 2, the chip inductor according to the exemplary embodiment may include a laminate 100 in which magnetic sheets 140 having C-pattern electrodes 141 formed thereon and magnetic sheets 150 having I-pattern electrode 151 formed thereon are alternately laminated, and external electrode terminals 200 provided on both side portions of the laminate 100. The laminate 100 is formed by laminating a number of magnetic sheets 140 and 150, pressing them, and then performing sintering. The magnetic sheets are so closely integrated that the boundaries therebetween are rarely found.

Figure 3A:
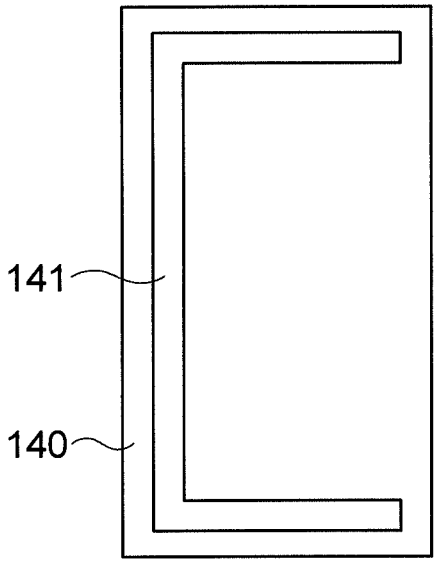
FIGS. 3A, 3B and 3C are views showing an example of a C-pattern electrode.
Figure 3B:
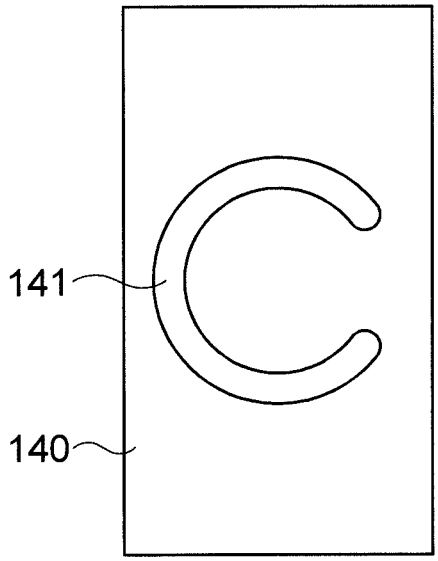
Figure 3C:
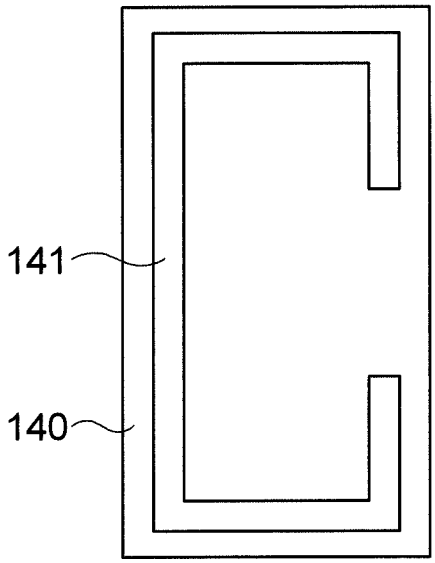

The C-pattern electrodes 141 refer to the electrodes patterned in a C shape and the I-pattern electrodes 151 refer to the electrodes patterned in an I shape. In a broader sense, the C-pattern electrode 141 may include all shapes having an opening in a closed loop, and the I-pattern electrode 151 may include all shapes connecting the gap in the opening. For example, the C-pattern electrode 141 may be an electrode patterned in a "⊂" shape as shown in FIG. 3A, or in a circular or quadrangular shape except for the opened gap as shown in FIG. 3B or 3C.

On one hand that the pattern lines of the C-pattern electrodes 141 have a circular or ellipsoidal curve, current flow is facilitated, to improve direct current resistance characteristics Rdc. On the other hand that the pattern lines have sharp edges such as a "⊂" shape shown in FIG. 3A or a quadrangular shape shown in FIG. 3C, the inner cross-sectional area may be larger, such that the inductance may be maximized.

Further, in order to implement higher inductance, it is advantageous to place the C-pattern electrodes 141 at the edges of the magnetic sheets 140 and 150. Therefore, depending on the rectangular shape of a chip, an ellipsoidal shape is preferred to a circular shape, and a rectangular shape is preferred to a square shape for the C-pattern electrode 141.

Referring back to FIG. 2, the C-pattern electrodes 141 and I-pattern electrodes 151 may be electrically connected to each other through vias 142 and 152 penetrating through the magnetic sheets 140 and 150. Specifically, the vias 142 and 152 may include first vias 142 formed on the magnetic sheets 140 on which the C-pattern electrodes 141 are formed and connecting one ends 141*a* of the C-pattern electrodes 141 to one ends 151*a* of the I-pattern electrode 151; and second vias 152 formed on the magnetic sheets 150 on which the I-pattern electrodes 151 are formed and connecting the other ends 151*b* of the I-pattern 151 to the other ends 141*b* of the C-pattern electrode 141.

That is, the one ends 141*a* of the C-pattern electrodes 141 are connected to the one ends 151*a* of the I-pattern electrodes 151 therebelow through the first vias 142, and the other ends 151*b* of the I-pattern electrodes 151 are connected to the other ends 141*b* of the C-pattern electrodes 141 therebelow through the second vias 152. In this configuration, a number of the C-pattern electrodes 141 and the I-pattern electrodes 151 are electrically connected to each other, and function as a coil.

By forming a coil with the C-pattern electrodes 141 and the I-pattern electrodes 151 as described above, the inner cross-sectional area of the coil is rarely changed even if a laminate alignment error between the magnetic sheets occurs during the manufacturing process, and thus a change in inductance may be minimized.

Figure 4A:
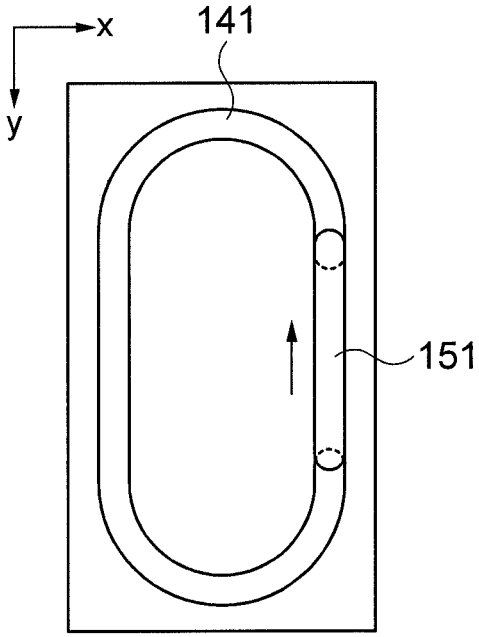
FIGS. 4A and 4B are plan views illustrating a connection structure between a C-pattern electrode and a I=pattern electrode when a laminate alignment error occurs.
Figure 4B:
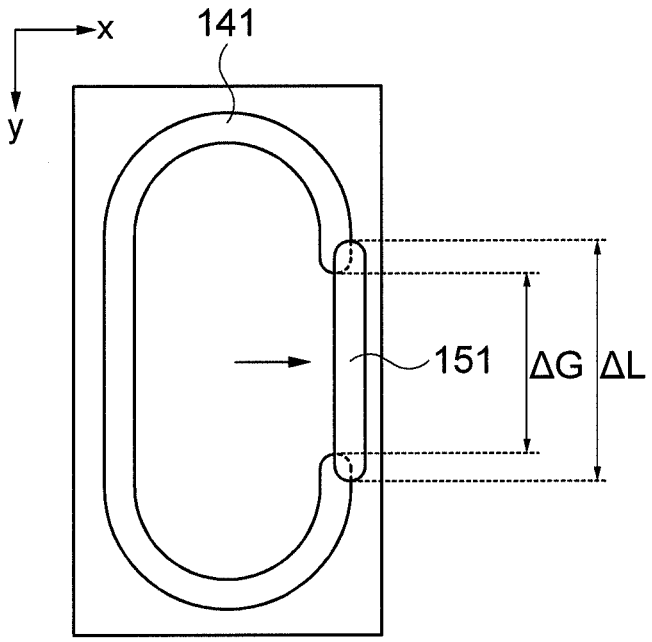

FIGS. 4A and 4B are plan views illustrating connecting structures between the C-pattern electrodes 141 and the I-pattern electrodes 151 when a laminate alignment error has occurred. Referring to FIGS. 4A and 4B, even if a laminate alignment error between the magnetic sheets occurs, the connecting structure of the C-pattern electrodes 141 and the I-pattern electrodes 151 according to the exemplary embodiment rarely has change in the inner cross-section area of the coil. As shown in FIG. 4A, when an alignment error has occurred in the y-axis direction so that the I-pattern electrodes 151 are moved upward, the inner cross-sectional area of the coil is not changed despite the displacement of the connecting position between the C-pattern electrodes 141 and the I-pattern electrodes 151.

Further, as shown in FIG. 4B, when an alignment error has occurred in the x-axis direction so that the I-pattern electrodes 151 are moved outward, the inner cross-sectional area of the coil is rarely changed since the changed inner cross-sectional area of the coil equals to merely the gap between the two ends of the C-pattern electrodes 141 (ΔG)×the distance by which the I-pattern electrodes 151 have been moved.

When the alignment error has occurred in the x-axis direction, it is advantageous that the gap ΔG between the two ends of the C-pattern electrodes 141 since the changed inner cross-sectional area of the coil is proportional to the gap ΔG. However, if the gap is too short, a short circuit may be caused between the two ends of the C-pattern electrodes 141 during the process of forming the C-pattern electrodes 141, for example, by a screen printing. Further, if the gap is too short, vias connecting the C-pattern electrodes 141 to the I-pattern electrodes 151 get close, such that steps may occur, thereby causing failure such as cracks or delamination. In view of the above, the gap ΔG between the two ends of the C-pattern electrodes 141 is preferably between 5 μm and 100 μm.

Further, in order to ensure the connection between the C-pattern electrodes 141 and the I-pattern electrodes 151, the length ΔL of the I-pattern electrodes 151 is preferably greater than the gap ΔG between the two ends of the C-pattern electrodes 141. Here, the length ΔL of the I-pattern electrode 151 includes the ends to which vias contacting.

As the length ΔL of the I-pattern electrode 151 relative to the gap ΔG between the two ends of the C-pattern electrodes increases, connection between the C-pattern electrodes 141 and the I-pattern electrodes 151 is more likely to be made. However, if the length ΔL is too long, one ends of the I-pattern electrodes 151 may cause a short circuit with external electrode terminals 200. In view of the above, the ratio of the length ΔL of the I-pattern electrode 151 to the gap ΔG between the two ends of the C-pattern electrodes 141 is preferably between 1.1 and 1.3.

Further, the gap ΔG between the two ends of the C-pattern electrodes 141 may be located on either a major axis or a minor axis of the C-pattern electrode. Assuming the magnetic sheet as quadrants, i.e., quadrants 1 to 4, the gap ΔG may be located at any one of the quadrants.

Figure 5A:
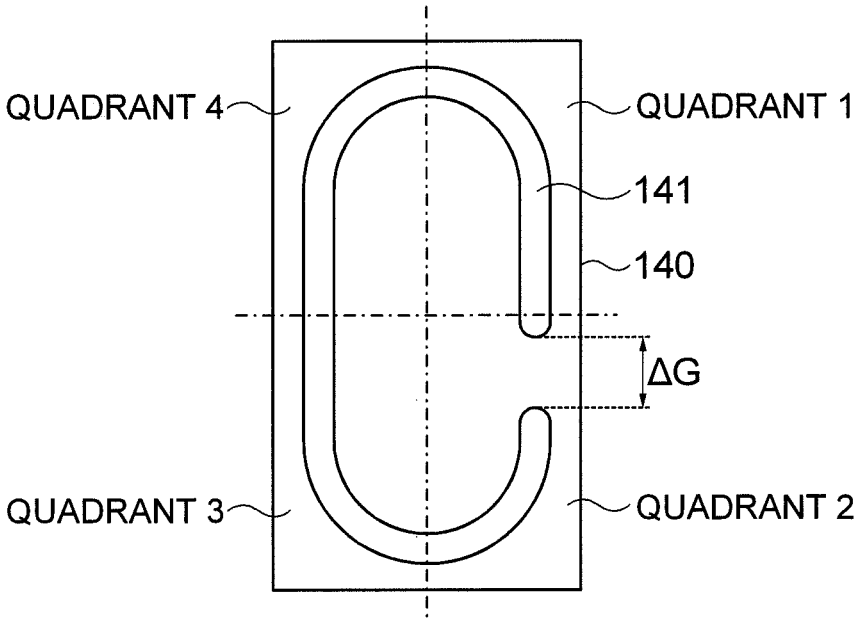
FIGS. 5A, 5B and 5C are plan views showing examples of locations where a C-pattern electrode is formed.
Figure 5B:
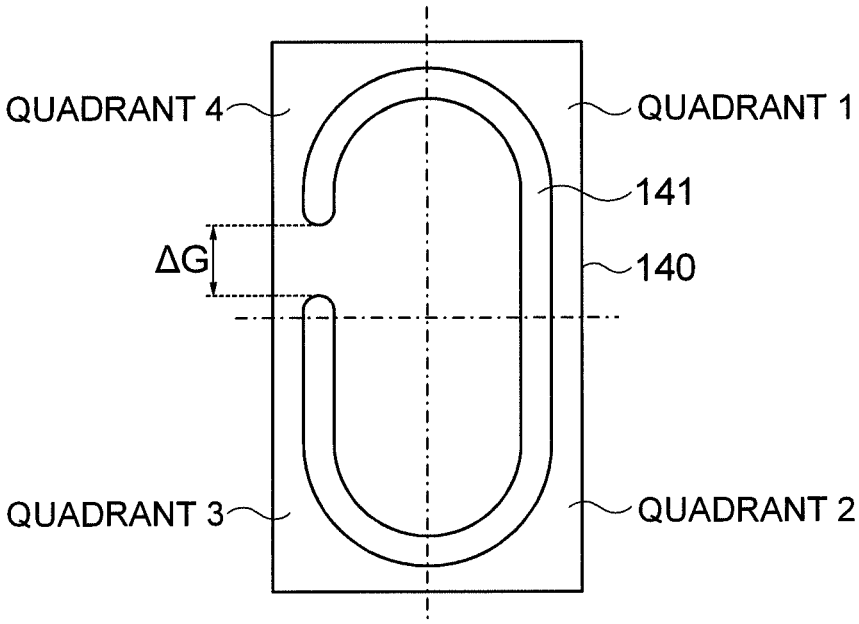
Figure 5C:
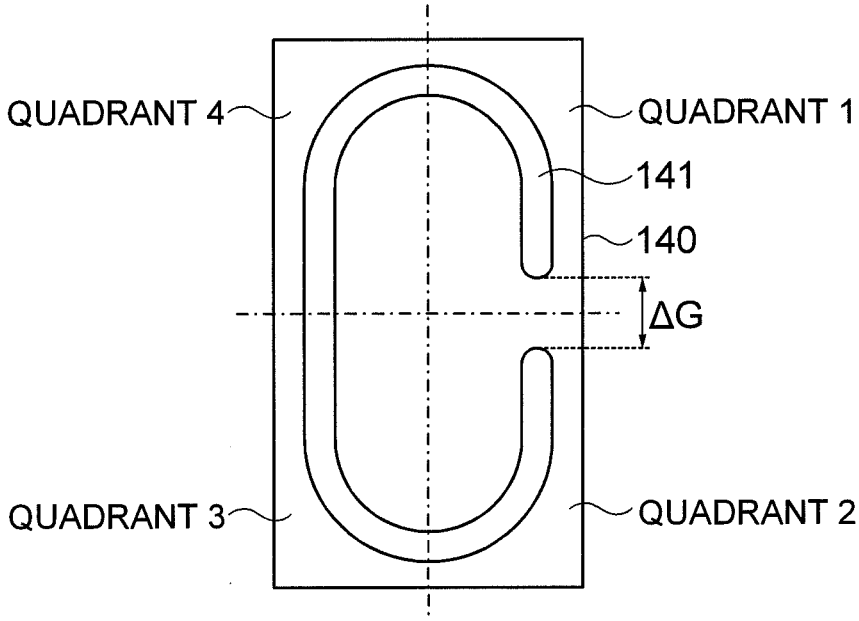
Figure 6:
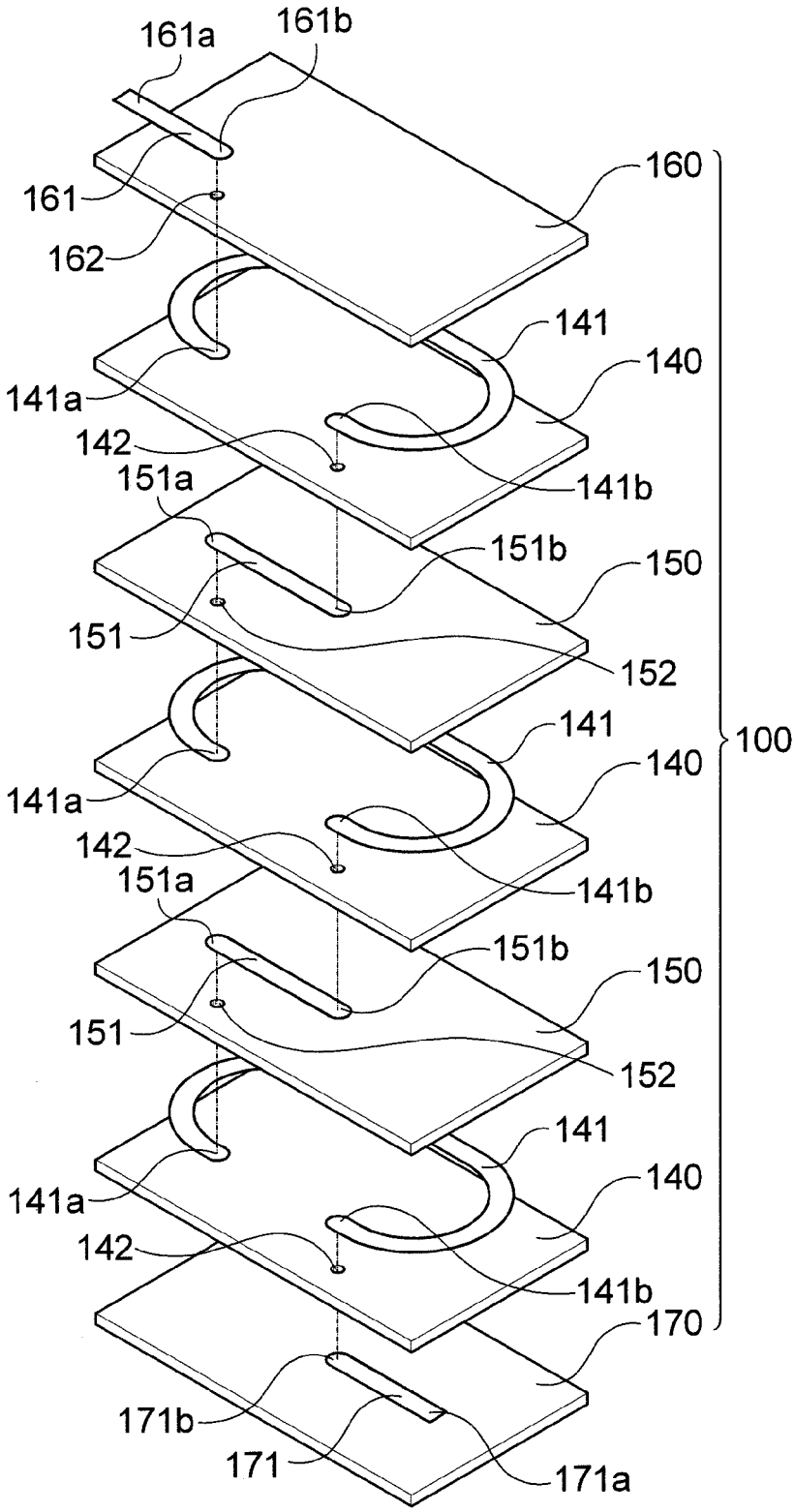
FIG. 6 is a view for illustrating a variant of a lead-out electrode included in the present invention.

For example, the gap ΔG between the two ends may be placed on quadrant 2 as shown in FIG. 5A, or on quadrant 4 as shown in FIG. 5B. Alternatively, the gap ΔG may be placed over two adjacent quadrants (quadrant 1 and 2), as shown in FIG. 5C. As is appreciated, the location of the gap ΔG between the two ends of the C-pattern electrodes 141 is not limited by the present invention.

Referring back to FIG. 2, the chip inductor according to the exemplary embodiment may further include magnetic sheets 160 and 170 having lead-out electrodes 161 and 171 in the uppermost layer and in the lowermost layer, respectively.

The lead-out electrodes 161 and 171 serve to connect the C-pattern electrode 141 or the I-pattern electrode 151 to the external electrode terminal 200. For example, one end 161*a* of the lead-out electrode 161 formed on the magnetic sheet 160 in the uppermost layer may be connected to the external electrode terminal 200 at the left (or right) hand, and the other end 161*b* may be connected to the C-pattern electrode 141 in the lower layer through a via 162 penetrating through the magnetic sheet 160.

Likewise, one end 171*a* of the lead-out electrode 171 formed on the magnetic sheet 170 in the lowermost layer may be connected to the external electrode terminal 200 at right (or left) hand, and the other end 171*b* may be connected to the C-pattern electrode 141 in the upper layer through a via 142 penetrating through the magnetic sheet 140. Although FIG. 2 shows that the lead-out electrodes 161 and 171 are connected to the C-pattern electrodes 141, it is to be understood that the lead-out electrodes 161 and 171 may be connected to the I-pattern electrodes 151 depending on the laminating order of the C-pattern electrodes 141 and the I-pattern electrodes 151.

Here, by taking current flow into consideration, the lead-out electrodes 161 and 171 may be placed so that the current flow at the contacting point of the lead-out electrodes 161 and 171 and the C-pattern electrode (or I-pattern electrode) in the lower or upper layer is in the forward current direction.

For example, when the lead-out electrodes 161 and 171 are connected to the C-pattern electrode 141, among two ends 141*a*, 141*b* of the C-pattern electrode 141, the end 141*b*, for example, closer to the external electrode terminal 200 at the right hand may be connected to the lead-out electrode 161 connected to the external electrode terminal 200 at the left hand, and the end 141*a* closer to the external electrode terminal 200 at the left hand may be connected to the lead-out electrode 171 connected to the external electrode terminal 200 at the right hand. When the lead-out electrodes 161 and 171 are connected to the I-pattern electrode 151, among two ends 151*a*, 151*b* of the I-pattern electrode 151, the end closer to the external electrode terminal 200 at the right hand may be connected to the lead-out electrode connected to the external electrode terminal 200 at the right hand, and the end closer to the external electrode terminal 200 at the left hand may be connected to the lead-out electrode connected to the external electrode terminal 200 at the left hand.

In this configuration, the current input through the external electrode terminal 200 may flow without direction change at the contacting point of the lead-out electrodes 161 and 171 with the C-pattern electrode 141 (or the I-pattern electrode 151).

As is appreciated, on the contrary to this, the lead-out electrodes 161 and 171 may be placed so that the current flow at the contacting point of the lead-out electrodes 161 and 171 and the C-pattern electrode (or I-pattern electrode) in the lower or upper layer is in the reverse current direction.

The chip inductor according to the exemplary embodiment may be formed by alternately laminating magnetic sheets 140 having C-pattern electrodes 141 formed thereon and magnetic sheets 150 having I-pattern electrode 151 formed thereon, pressing them, and then performing sintering, to give a laminate 100, and by forming external electrode terminals 200 at both side portions of the laminate 100.

During the manufacturing process, even if a laminate alignment error between the magnetic sheets occurs in the x- or y-axis direction, the chip inductor according to the exemplary embodiment rarely has change in the inner cross-sectional area so that change in inductance is minimized, as shown in FIGS. 4A and 4B.

Such laminate alignment errors are likely to occur during the manufacturing process using magnetic sheets on which a number of C-pattern electrodes 141 and I-pattern electrodes 151 are printed on a surface. The chip inductor according to the present invention may minimize change in the inner cross-sectional area of the coil due to the laminate alignment errors.

Now, a manufacturing method of the chip inductor according to an exemplary embodiment using a magnetic sheet 110 having a number of C-pattern electrodes 141 and I-pattern electrodes 151 printed on a surface will be described. Initially, C-pattern electrode and I-pattern electrodes are formed on each region on the magnetic sheet divided into several regions. Prior to this, via holes may be formed in predetermined locations of the magnetic sheet 100, and then may be filled with conductive paste so as to form vias (142 and 152 of FIG. 2).

Figure 7A:
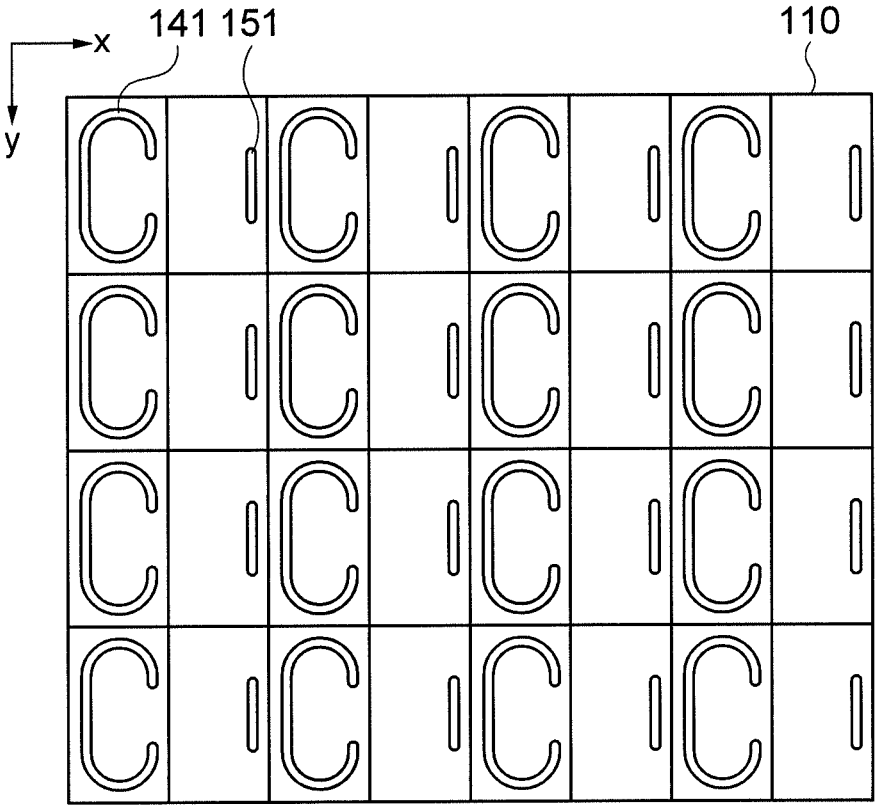
FIGS. 7A, 7B and 7C are plan views for illustrating placing orders of the C-pattern electrodes and the I-pattern electrodes.
Figure 7B:
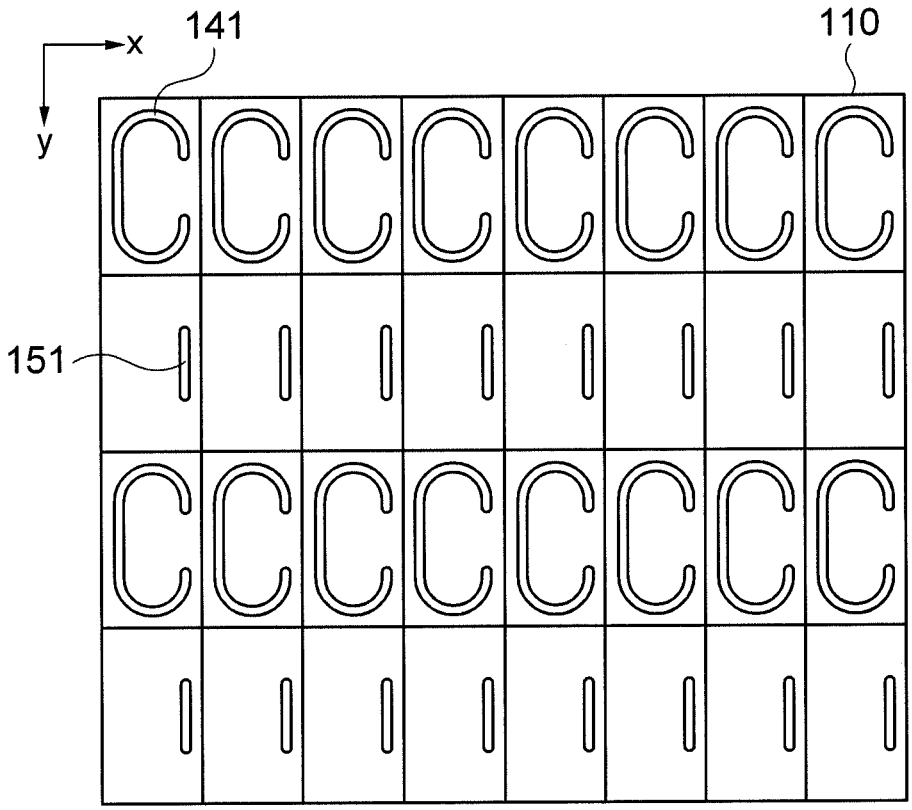
Figure 7C:
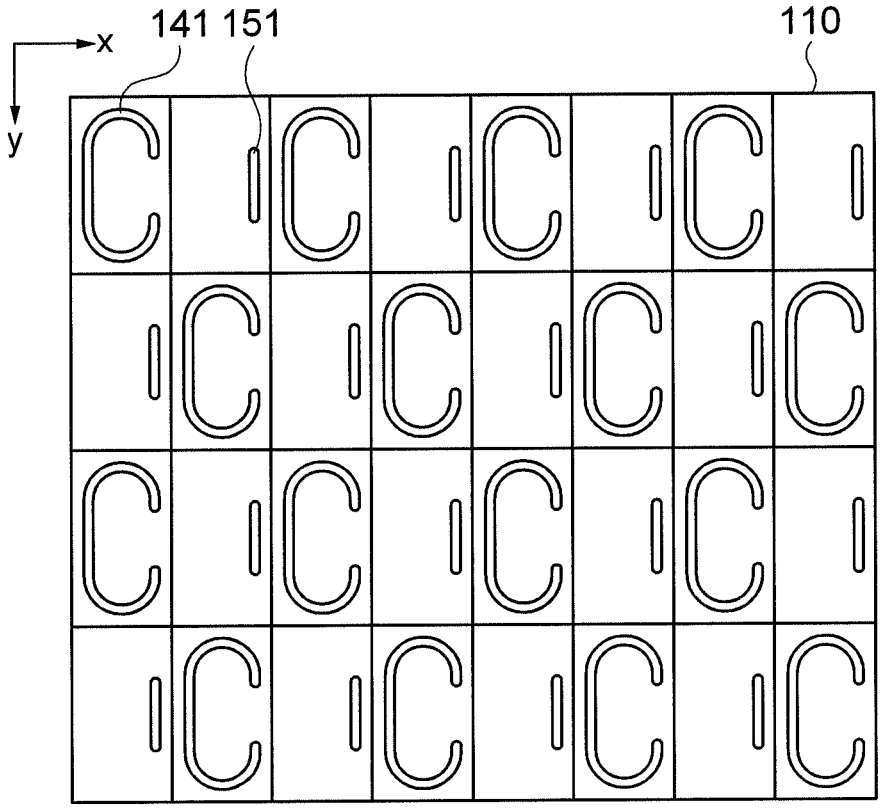

The C-pattern electrodes 141 and the I-pattern electrodes 151 may be formed using a known technique such as screen printing, and the C-pattern electrodes 141 and the I-pattern electrodes 151 are alternately formed. That is, the C-pattern electrodes 141 and the I-pattern electrodes 151 may be alternately formed in the x-axis direction as shown in FIG. 7A or in the y-axis direction as shown in FIG. 7B. Alternatively, the C-pattern electrodes 141 and the I-pattern electrodes 151 may be alternately formed in both the x- and y-axis directions as shown in FIG. 7C.

Subsequently, a number of magnetic sheets 110 on which the C-pattern electrodes 141 and the I-pattern electrodes 151 are printed are laminated on one another. Here, magnetic sheets in the upper or lower layer are moved by one region.

Figure 8A:
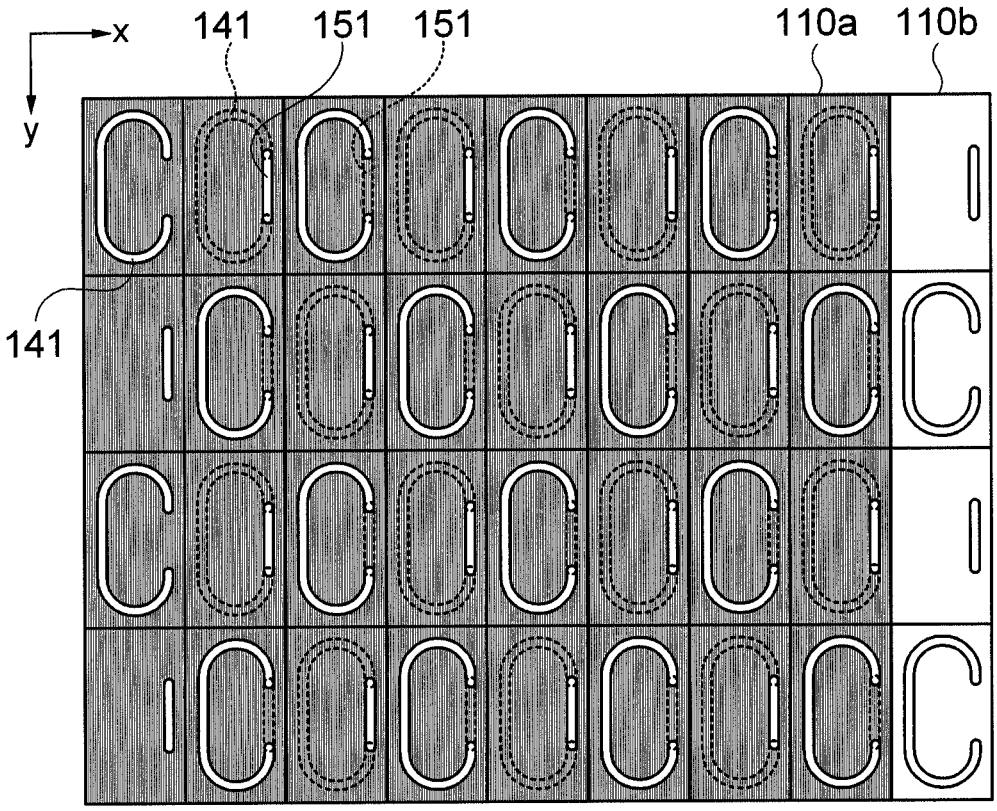
FIGS. 8A and 8B are plan views illustrating that magnetic sheets having a number of C-pattern electrodes and the I-pattern electrodes on a surface are laminated.
Figure 8B:
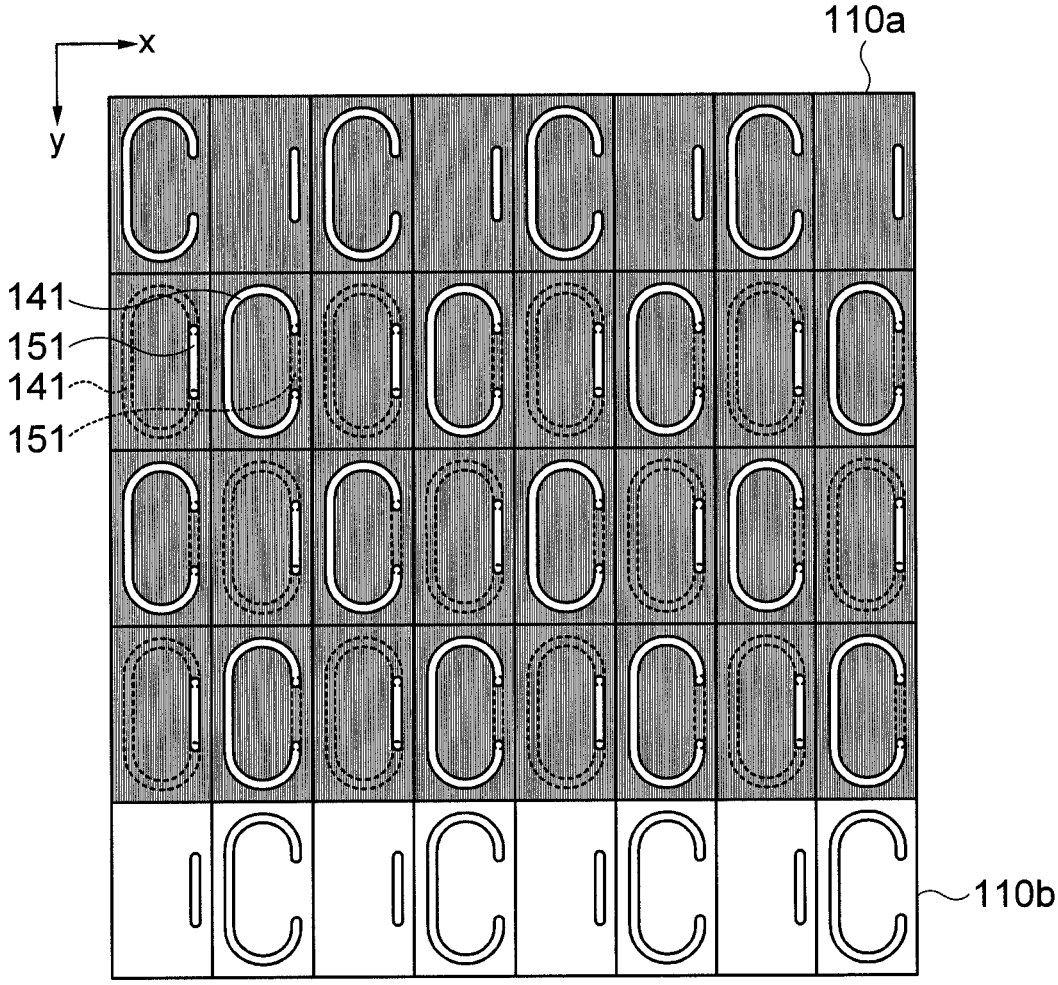

FIGS. 8A and 8B are plan views illustrating an example in which two magnetic sheets are laminated. Here, the shaded magnetic sheets 110*a* are placed in the upper layer whereas white magnetic sheets 110*b* are placed in the lower layer.

The laminate process will be described with reference to FIG. 8A. When the magnetic sheets are used on which the C-pattern electrodes 141 and the I-pattern electrodes 151 are alternately formed in the x- and y-axis directions as shown in FIG. 7C, the magnetic sheets are laminated so that the magnetic sheets 110*a* and 110*b* in the upper or lower layer are moved in the x-axis direction by one region as shown in FIG. 8A or in the y-axis direction by one region as shown in FIG. 8B. By doing so, the C-pattern electrodes 141 in the upper layers (or the I-pattern electrodes 151 in the upper layers) and the I-pattern electrodes 151 in the lower layers (or the C-pattern electrodes 141 in the lower layers) are aligned with respect to each other and connected through vias.

Likewise, when the magnetic sheets are used on which the C-pattern electrodes 141 and the I-pattern electrodes 151 are alternately formed in the x-axis direction as shown in FIG. 7A, the magnetic sheets in the upper or lower layers are moved in the x-axis direction by one region. When the magnetic sheets are used on which the C-pattern electrodes 141 and the I-pattern electrodes 151 are alternately formed in the y-axis direction as shown in FIG. 7B, the magnetic sheets in the upper or lower layers are moved in the y-axis direction by one region.

As above, when a magnetic sheet is used on which a number of C-pattern electrodes 141 and I-pattern electrodes 151 are alternately place on a surface, it is required to move the magnetic sheets in the upper or lower layers during the laminate process, and a laminate alignment error is likely to occur. However, in the chip inductor according to the exemplary embodiment of the present invention, even if such a laminate alignment error occurs, the inner cross-sectional area of the coil rarely changes so that change in inductance is minimized, as shown in FIGS. 4A and 4B.

After a number of magnetic sheets are laminated, the magnetic sheets are pressed and sintered, and the laminate is cut into individual laminate. Finally, external electrode terminals are formed at both side portions of the individual laminate, to obtain the chip inductor according to the exemplary embodiment.

The chip inductor according to the present invention may be formed using magnet sheets on which the same kind of pattern electrodes is formed on a surface.

Figure 9A:
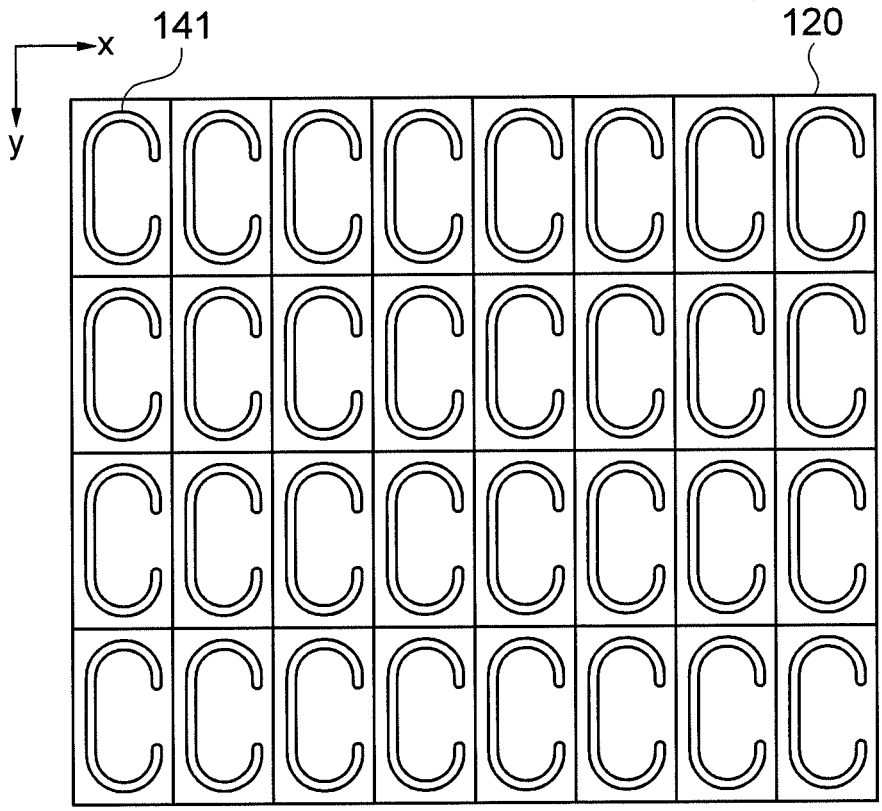
FIG. 9A is a plan view of a first magnetic sheet on which a C-pattern electrode is formed, and FIG. 9 B is a plan view of a second magnetic sheet on which a I-pattern electrode is formed.
Figure 9B:
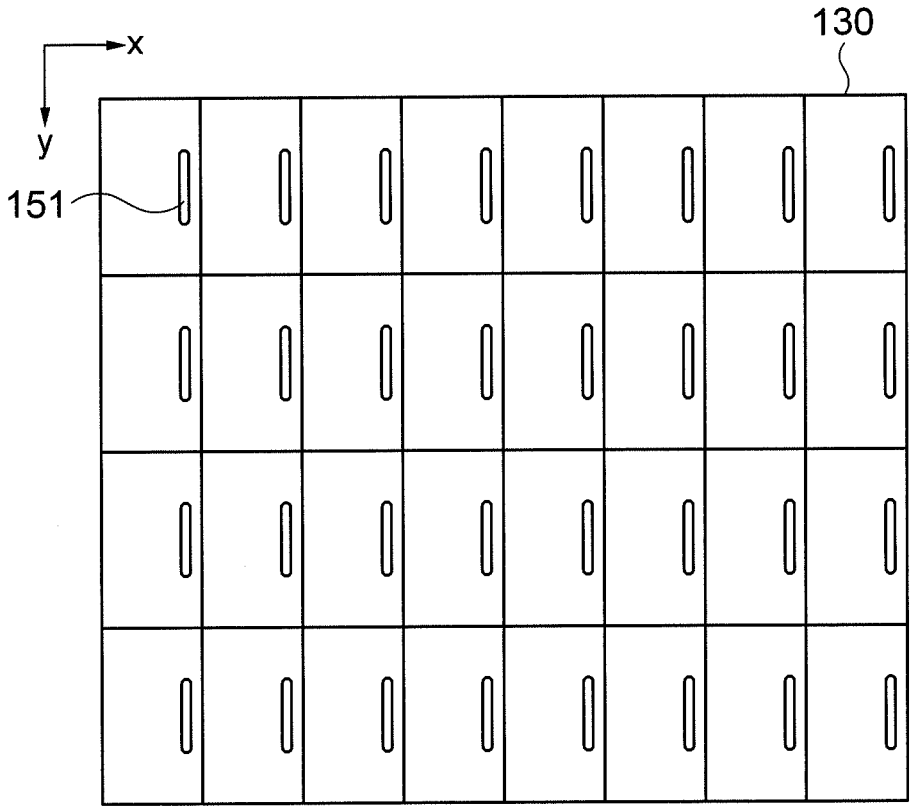

Specifically, C-pattern electrodes are formed on each region of a first magnetic sheets 120 divided as shown in FIG. 9A, and I-pattern electrodes are formed on each region of a second magnetic sheet 130 divided as shown in FIG. 9B.

Figure 10:
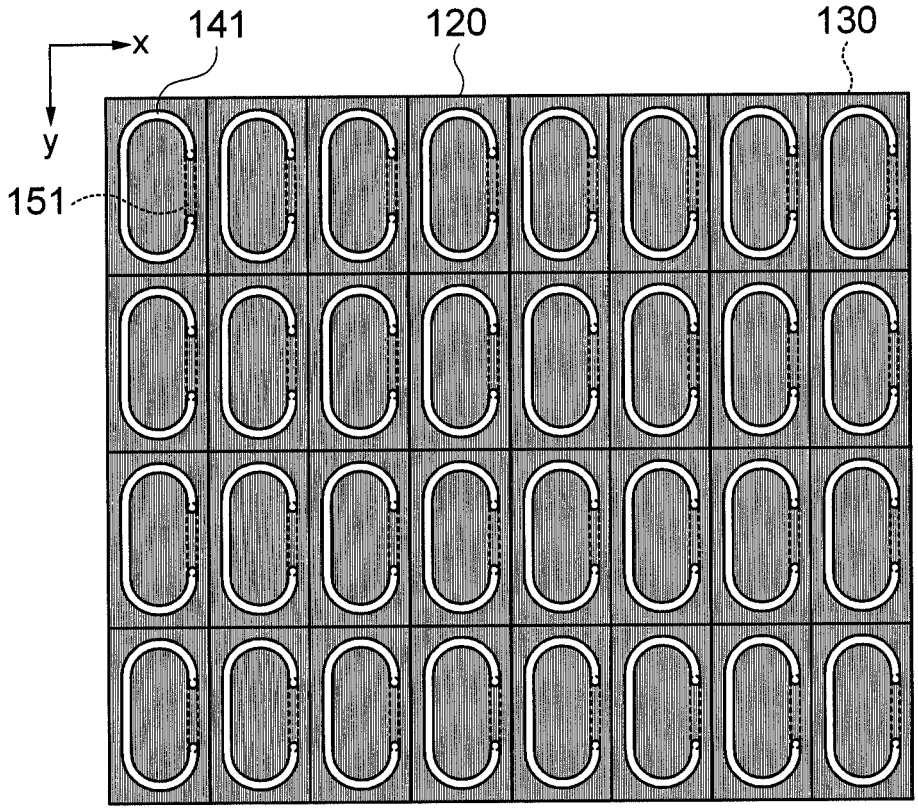
FIG. 10 is a plan view illustrating that first and second magnetic sheets are laminated.
Figure 11:
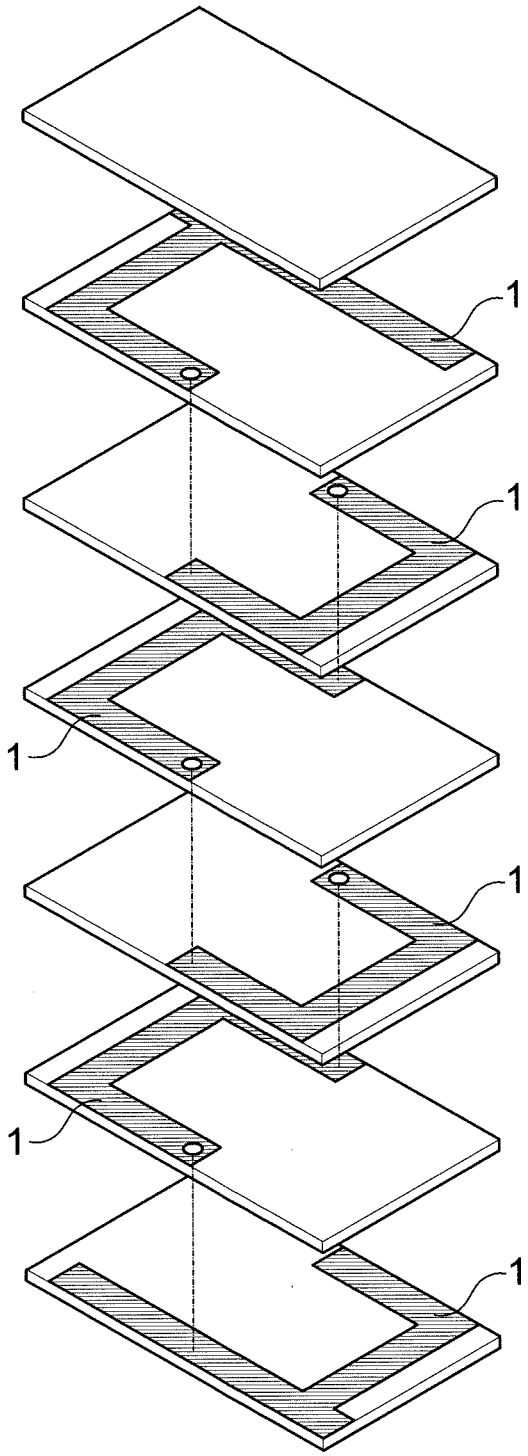
FIG. 11 is a view showing a chip inductor disclosed in the related art document.
Figure 12A:
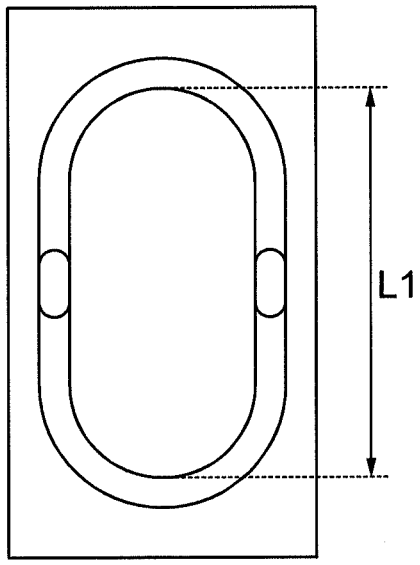
FIGS. 12A and 12B are plan views showing inside of the chip inductor in the related art when a laminate alignment error occurs.
Figure 12B:
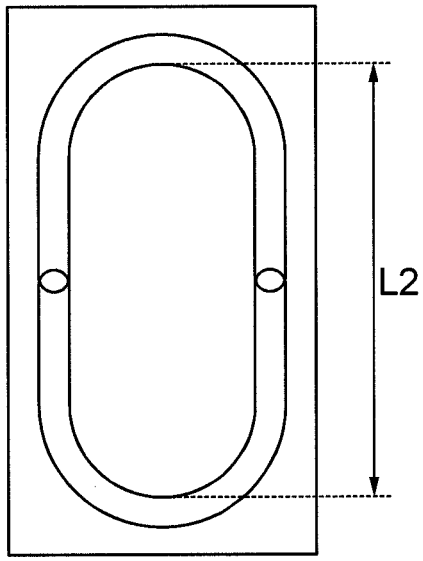

Then, as shown in FIG. 10, the first magnetic sheet 120 and the second magnetic sheet 130 are alternately laminated. In this case, unlike FIGS. 8A and 8B, it is not required to move electrodes and thus a laminate alignment error is less likely to occur. However, although it is less likely, a laminate alignment error may still occur. Even if a laminate alignment error occurs in this case, the chip inductor according to the exemplary embodiment rarely has change in the inner cross-sectional area of the coil so that change in inductance is minimized, as shown in FIGS. 4A and 4B.

After a number of first magnetic sheets 120 and second magnetic sheets 130 are laminated, the magnetic sheets are pressed and sintered, and the laminate is cut into individual pieces. Finally, external electrode terminals are formed at both side portions of the individual laminate, to obtain the chip inductor according to the exemplary embodiment.

As stated above, the inner cross-sectional area of a coil is rarely changed even if a laminate alignment error between the magnetic sheets occurs during the process of laminating the magnetic sheets, and thus a change in inductance can be minimized, and reliability of a product can be greatly increased.

The present invention has been described in connection with what is presently considered to be practical exemplary embodiments. Although the exemplary embodiments of the present invention have been described, the present invention may be also used in various other combinations, modifications and environments. In other words, the present invention may be changed or modified within the range of concept of the invention disclosed in the specification, the range equivalent to the disclosure and/or the range of the technology or knowledge in the field to which the present invention pertains. The exemplary embodiments described above have been provided to explain the best state in carrying out the present invention. Therefore, they may be carried out in other states known to the field to which the present invention pertains in using other inventions such as the present invention and also be modified in various forms required in specific application fields and usages of the invention. Therefore, it is to be understood that the invention is not limited to the disclosed embodiments. It is to be understood that other embodiments are also included within the spirit and scope of the appended claims.

What is claimed is:

1. A chip inductor, comprising:

a laminate in which a magnetic sheet having a C-pattern electrode formed thereon and a magnetic sheet having an I-pattern electrode formed thereon are alternately laminated, wherein the C-pattern electrode comprises a single gap having a straight shape, and the I-pattern electrode has a shape corresponding to the gap, and is arranged in a position corresponding to the gap;

a via penetrating through the magnetic sheet and connecting the C-pattern electrode and the I-pattern electrode; and an external electrode terminal provided at either side portion of the laminate.

2. The chip inductor according to claim 1, wherein the via includes:

a first via formed on the magnetic sheet on which the C-pattern electrode is formed and connecting one end of the C-pattern electrode to one end of the I-pattern electrode; and a second via formed on the magnetic sheet on which the I-pattern electrode is formed and connecting the other end of the I-pattern electrode to the other end of the C-pattern electrode.

3. The chip inductor according to claim 1, wherein a pattern line of the C-pattern electrode is a circle, an ellipse or a quadrangle.

4. The chip inductor according to claim 1, wherein a gap between the ends of the C-pattern electrode is between 5 μm and 100 μm.

5. The chip inductor according to claim 4, wherein a length of the I-pattern electrode is greater than the gap between the ends of the C-pattern electrode.

6. The chip inductor according to claim 5, wherein a ratio of the length of the I-pattern electrode to the gap between the ends of the C-pattern electrode is between 1.1 and 1.3.

7. The chip inductor according to claim 1, wherein, assuming the magnetic sheet as four virtual quadrants, a gap between the ends of the C-pattern is placed on any one of the quadrants or placed over two adjacent quadrants.

8. The chip inductor according to claim 1, wherein a gap between the ends of the C-pattern electrode is located on a major axis of the C-pattern electrode.

9. A chip inductor, comprising:

a laminate in which a magnetic sheet having a C-pattern electrode formed thereon and a magnetic sheet having an I-pattern electrode formed thereon are alternately laminated, wherein the C-pattern electrode has a single gap having straight shape, and the I-pattern electrode has a shape corresponding to the gap, and is arranged in a position corresponding to the gap;

a via penetrating through the magnetic sheet and connecting the C-pattern electrode and the I-pattern electrode;

an external electrode terminal provided at either side portion of the laminate; and a magnetic sheet having a lead-out electrode formed thereon in each of an uppermost layer and lowermost layer of the laminate, wherein one end of the lead-out electrode formed on the magnetic sheet in the uppermost layer is connected to the external electrode terminal at one of the left hand or right hand, and the other end is connected to one of the C-pattern electrode or the I-pattern electrode in a lower layer, wherein one end of the lead-out electrode formed on the magnetic sheet in the lowermost layer is connected to the external electrode terminal at one of the right hand or left hand, and the other end is connected to one of the C-pattern electrode or the I-pattern electrode in the upper layer.

10. The chip inductor according to claim 9, wherein the lead-out electrode is placed so that current flow is in forward direction at a contacting point between the lead-out electrode and the C-pattern electrode or the I-pattern electrode in the lower or upper layer.

* * * * *